US008544898B2

(12) United States Patent
Zimmer et al.

(10) Patent No.: US 8,544,898 B2
(45) Date of Patent: Oct. 1, 2013

(54) DAMPING MECHANISM FOR HINGED DOORS

(76) Inventors: Günther Zimmer, Rheinau (DE); Martin Zimmer, Rheinau (DE)

( * ) Notice: Subject to any disclaimer, the term of this patent is extended or adjusted under 35 U.S.C. 154(b) by 1000 days.

(21) Appl. No.: 12/220,072

(22) Filed: Jul. 21, 2008

(65) Prior Publication Data

US 2009/0031528 A1 Feb. 5, 2009

(30) Foreign Application Priority Data

Jan. 21, 2006 (DE) ..... 10 2006 002 951

(51) Int. Cl.
*E05C 1/02* (2006.01)
*E05C 1/08* (2006.01)

(52) U.S. Cl.
USPC ..... 292/137; 292/163; 292/169; 292/173; 16/85

(58) Field of Classification Search
USPC ..... 292/137, 138, 163, 169, 173, DIG. 55; 16/85, 86 A, 86 R; 49/394; 70/131, 136
See application file for complete search history.

(56) References Cited

U.S. PATENT DOCUMENTS

| | | | | | |
|---|---|---|---|---|---|
| 1,147,284 | A * | 7/1915 | Vickers | 292/173 |
| 1,593,227 | A * | 7/1926 | Taylor | 292/169.21 |
| 1,711,213 | A * | 4/1929 | Smith | 292/198 |
| 2,390,076 | A * | 12/1945 | Deal | 292/167 |
| 2,490,213 | A * | 12/1949 | Dickson | 292/182 |
| 3,912,311 | A * | 10/1975 | Carvell et al. | 292/216 |
| 5,201,512 | A * | 4/1993 | Rabin | 271/164 |
| 6,570,757 | B2 * | 5/2003 | DiFonzo et al. | 361/679.27 |
| 7,325,844 | B2 * | 2/2008 | Salice | 292/300 |

* cited by examiner

*Primary Examiner* — Carlos Lugo
(74) *Attorney, Agent, or Firm* — Klaus J. Bach

(57) ABSTRACT

In a damping mechanism for a pivot door arranged in a door frame, comprising a door fixture arranged in or on the door panel, a frame fixture arranged in or on the door frame, a damper arrangement arranged in the door fixture or the frame fixture and a damper arrangement counter part mounted in the frame fixture or in the door fixture, a damper arrangement with a brake catcher provided with a damper member includes a spring element which pulls the brake catcher into the fixture and the damper arrangement counter part includes at least one trigger element which is abutted by the brake catcher during closing of the door, so that the damper arrangement begins to dampen the pivot movement of the door as soon as a fixture part of the door comes into contact with a fixture part of the door frame.

11 Claims, 4 Drawing Sheets

Fig. 2
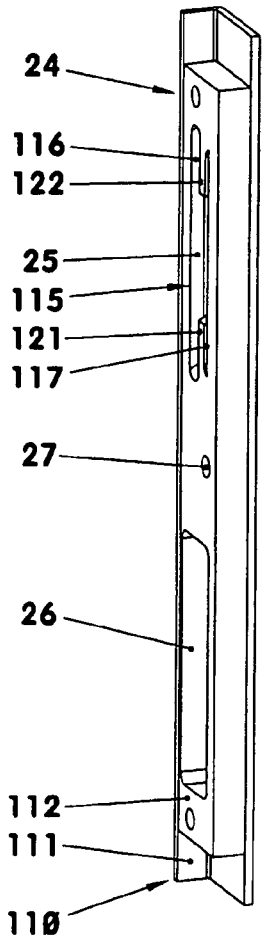
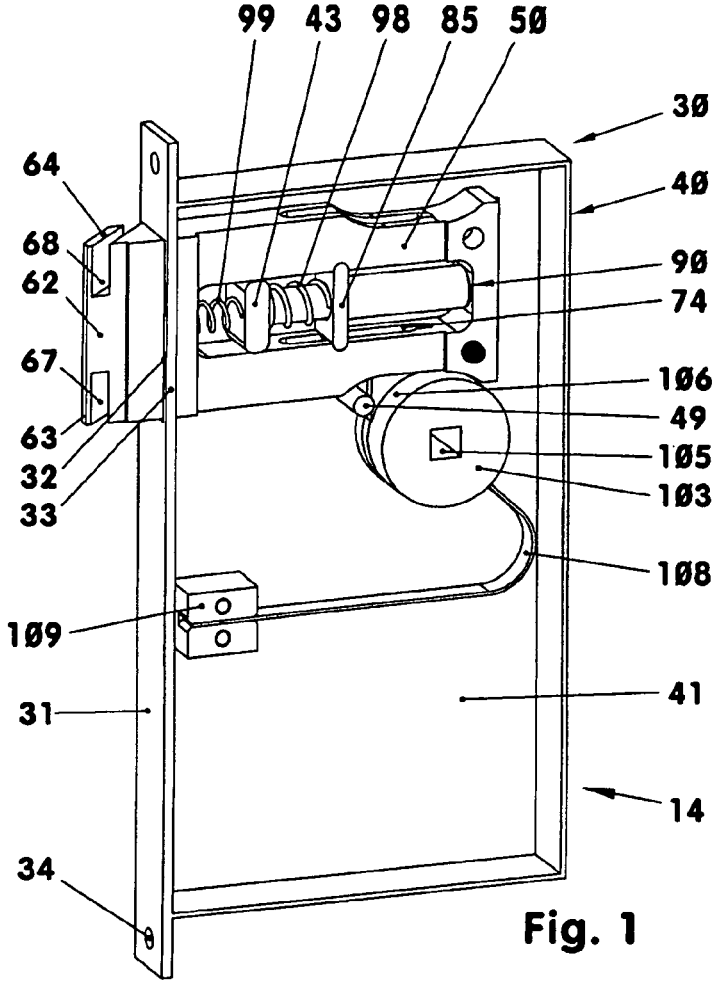
Fig. 1
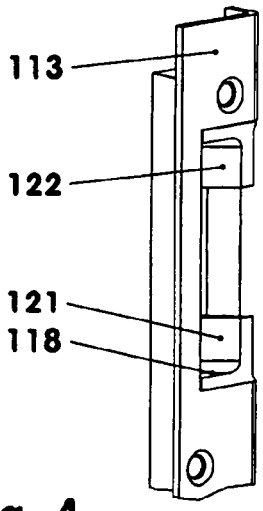
Fig. 4
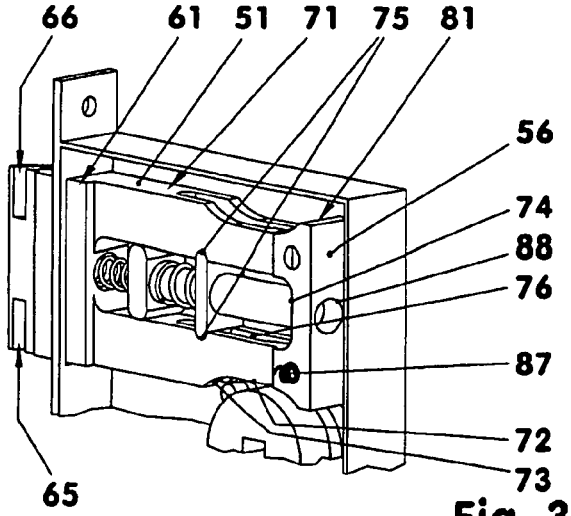
Fig. 3

Fig. 11
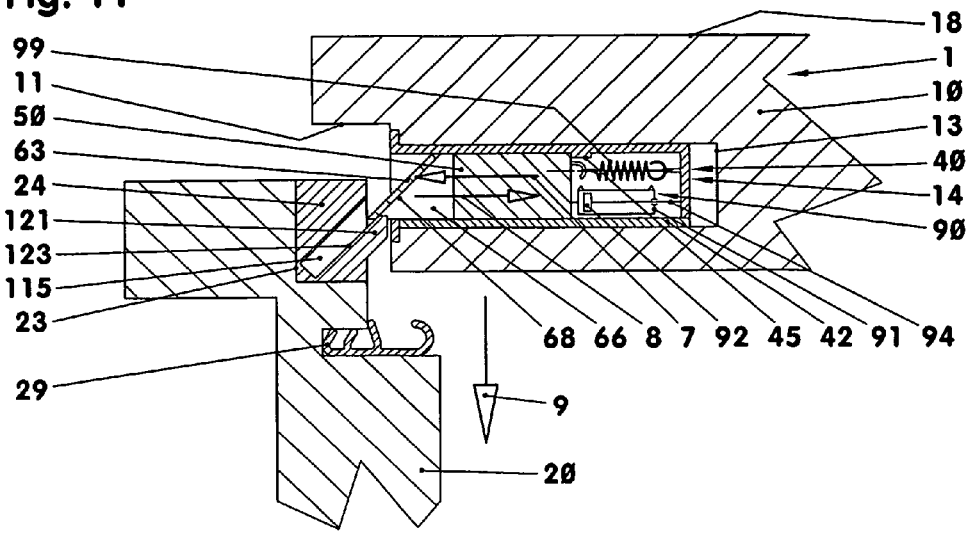
Fig. 12
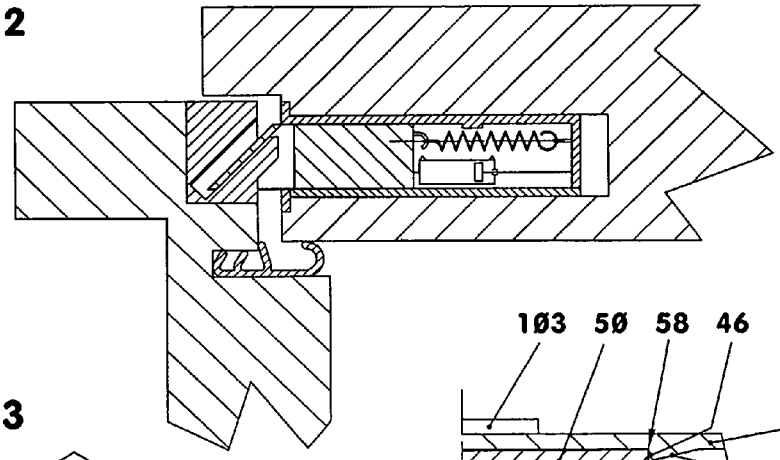
Fig. 13
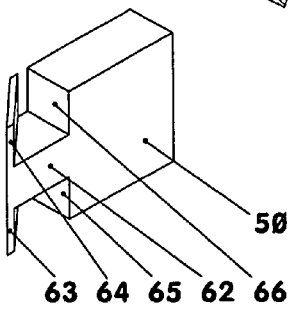
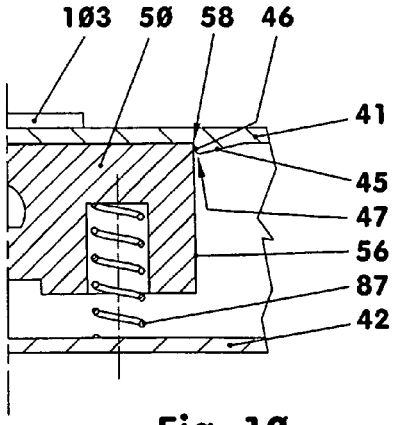
Fig. 10

DAMPING MECHANISM FOR HINGED DOORS

BACKGROUND OF THE INVENTION

The invention resides in a damping mechanism for a hinged door arranged in a door frame, with door fittings arranged in, or on, the door panel, frame fittings arranged in, or on, the door frame, a damper arrangement, which is arranged in the door fittings or the frame fittings and a damper arrangement counter piece which is mounted in the frame fittings or in the door fittings.

From the technical publication "Holztechnik" of the Europa-Lehrmittelverlag, 15$^{th}$ edition, 1005, pages 461-462, an insertion lock for house doors is known whose lock catcher engages into a lock metal sheet. The lock catcher, which is held by a spring in an extended position is a damper arrangement based on friction. The lock metal sheet forms with its catcher opening the counter part of the damper arrangement. When the door closes, the lock catcher hits the outer contour of the lock metal sheet. By the impulse of the impact, which is noticeable by a loud noise, the lock catcher is moved against the force of the above-mentioned spring into the insert lock. The inclined front face—it faces away from the door panel overlay—brakes the door movement by frictionally sliding along the lock sheet metal.

It is the object of the present invention to provide a damper fixture for pivot doors which begins to dampen the pivot movement of the door as soon as either a fixture part of the door contacts a fixture part of the door frame or a fixture part of the door contacts the wall supporting the door.

SUMMARY OF THE INVENTION

The object is solved by a damper arrangement which comprises a brake catcher with at least one braking surface which is supported in the door- or frame fixture and is pulled by a spring element into a rear position and is retained therein. The damper arrangement includes a damper member which is arranged between the brake catcher and the door- or frame fittings. The damper arrangement counterpart comprises at least one trigger element with an engagement flank which is directly or indirectly contacted by the brake surface upon closing of the door, in order to slow down the closing movement of the door panel by the operation of the damper member.

The damper arrangement is only activated when the damped door is almost closed already. As soon as the lock fitting of the door panel contacts the frame fitting of the door frame, the damping of the door starts. Then, the front edge of the lock fitting is spaced from the door frame seal according to FIG. 11 by only about 10-25 millimeter, depending on the wall thick-ness of the door panel.

The damper arrangement, which functions generally also without the door being held closed, is installed in the exemplary embodiment in a lock box integrated into the door panel. But it may also be integrated into the fitting of the door frame. In that case, the trigger elements are arranged in, or on, the door panel.

The damper fixture damps every door closing movement which can be initiated for example by the way the door is supported. It is for example possible to provide for a slightly inclined pivot axis of the door panel. Also, the opposite front faces of the door hinges could, at least in particular areas, extend coil-like around their posts. Further, the door panel may be supported on the door frame by a lift rod which is arranged near the door pivot axis. In all three cases, the weight force of the door panel is used for closing the door. Alternatively, a floor door closer, an automatic door closer or a coil spring integrated into the door hinge in a tensioned state may be used. These variants generate a closing movement by means of a pretensioned mechanical spring.

The invention will become more readily apparent from the following description of schematically shown embodiments on the basis of the accompanying drawings.

BRIEF DESCRIPTION OF THE DRAWINGS

It is shown in:

FIG. 1: a dimetric view of a damper arrangement with a brake catcher;

FIG. 2: a dimetric view of a damper arrangement counter part;

FIG. 3: another partial view of FIG. 1,

FIG. 4: another partial view of FIG. 2,

FIG. 10: the rear brake catcher area with the brake catcher extended, FIG. 11: a door panel and frame cross-section in a simplified representation of the damper arrangement with the door open, FIG. 12: like FIG. 11, but with the door closed, FIG. 13: the brake catcher, simplified.

DESCRIPTION OF PARTICULAR EMBODIMENTS OF THE INVENTION

Figure 5:
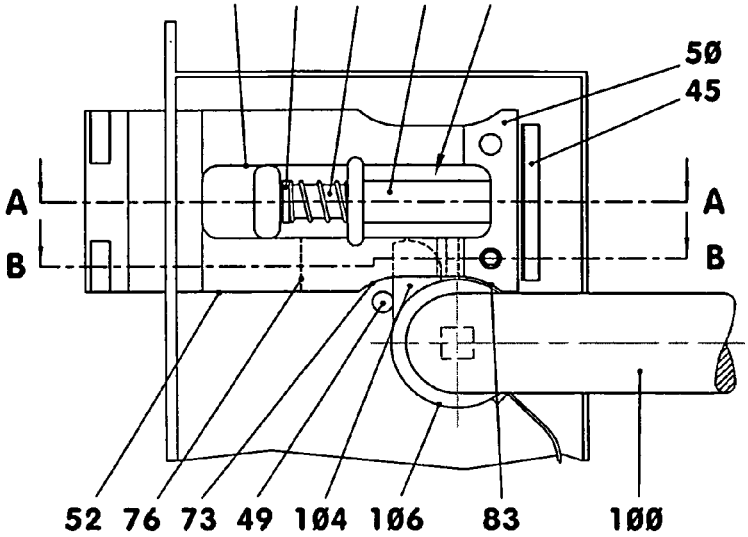
FIG. 5: a partial side view of FIG. 1.

The FIGS. 1, 3 and 5 show the damper mechanism (30) of the damper arrangement as it is installed for example in the door panel (10), see FIG. 11, of a revolving or, respectively, a pivot door (1). The damper arrangement (30) includes as a housing a lock box (40) which is mounted to the door panel (10) for example, by way of a cover plate (31). The cover (42) of the lock box (40) is shown in FIGS. 10 and 11.

Figure 6:
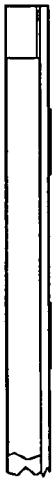
FIG. 6: a partial side view of FIG. 2.

The lock box (40), in this case, includes the brake catcher (50), a pivot nut (103) and a chain spring (108) with a support structure (109) therefor. The brake catcher (50), which in this case is arranged in the upper area of the lock box (40), is disposed above the pivot nut (103). The pivot nut (103) is moved by way of handle (100), see FIGS. 6 and 7. The chain spring (108) is disposed below the pivot nut (103). The brake catcher (50) can be divided into three sections (61, 71, 81). The first section is the head section (61). The latter is disposed, with play, in the, for example, rectangular catcher opening (32) of the cover plate (31). The front area of the head section (61) is for example wedge-shaped. Its front face (55) extends for example at an angle of 45 angular degrees with respect to the lock bottom side (53). The line extending normal to the front face (55) is oriented away from the direction (9) of the door-closing movement, that is, the front face (55) is directed toward the overlay (11) of the door panel (10), see FIG. 11, and not directed away therefrom as it is known from DIN 18251 for insertion locks.

The head section (61) has near the front face (55) thereof two, for example, groove-like cut-outs (65, 66). One of the cutouts (65, 66) is open at the top side (51) and the other at the bottom side (52) of the brake catcher (50). Each cut out (65, 66) has a wall (67, 68), which extends with respect to the lock bottom side (53) at an angle of, for example, 45 angular degrees. In the embodiment according to FIGS. 1-9, these walls (67, 68) are shown, only by way of example, at least approximately parallel to the front face (55). Between the individual walls (67, 68) and the front face (55) as a result, in each case, a brake web (63, 64) is formed. The walls (67, 68) represent the brake surfaces of the brake webs (63, 64). The cutouts (65, 66) have in accordance with FIGS. 1, 3, 5, 8 and 9, the shape of a rectangular groove and in accordance with FIGS. 11 to 13, they are wedge shaped.

Figure 7:
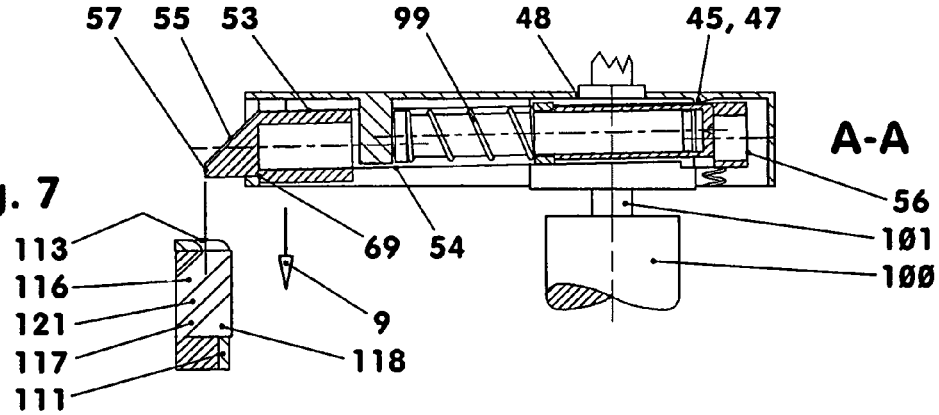
FIG. 7: a cross-section of the damper structure with the door open.
Figure 8:
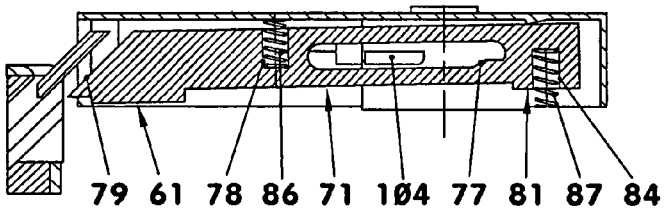
FIG. 8: the same as FIG. 7, but the door being in contact with the frame.
Figure 9:
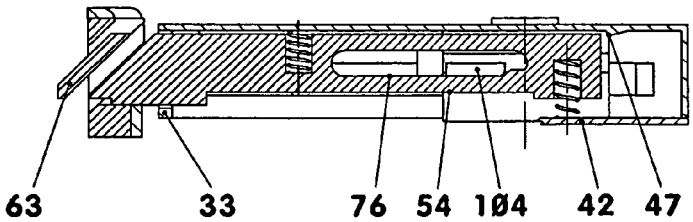
FIG. 9: a cross-section of the damper arrangement with the door closed.

The head section (61) is provided at the lock bottom side (53) of the brake catcher (50) with an engagement ledge (69), see FIGS. 7 to 9. The thickness of the brake catcher (50) becomes larger in this way behind the brake catcher tip (57) by for example one millimeter.

The second section is the center section (71). It has at least in the rear area near the pivot nut (103), a cutout (72) with two partial cylindrical flanks (73, 83), see FIGS. 3 and 5. The front flank (73) serves as the rear stop of the brake catcher (50) whereas the rear flank (83), which belongs to the foot section (81), forms the front brake catcher stop. The flanks (73, 83) come into contact with the cylindrical outer wall (106) of the pivot nut (103) as stop.

The center section (71) further includes an elongated damper opening (74) which extends from the lock bottom side (53) to the lock cover side (54). Herein, a damper (90) and a spring element (99) are arranged. The elongated damper opening (74) has in the center area oppositely arranged grooves (75) which are facing each other and in which a support plate (85) is accommodated for supporting the damper (90) among others. Transversely to the elongated damper opening (74), there is in the center section (71) an elongated cam opening (76), which connects the elongated damper opening (74) to the catcher bottom side (52). The pivot nut (103) has a cam (104) which extends into that elongated cam opening (76), see FIGS. 5, 8, and 9. In the rear area, the elongated cam opening (76) has a ramp-like step (77).

Between the elongated cam opening (76) and the head section (61), there is in the center section (71) disposed on the lock bottom side (53), a dead end bore (78) in which a coil compression spring (86) is supported forming an engagement spring (86). The engagement spring (86) which is supported on the lock bottom wall (41) biases the brake catcher (50) against the edge of the catcher opening (25), see FIGS. 8 and 9.

The foot section (81) has formed in the lock cover side (54), near the rear flank (83), a dead end bore (84). The latter supports a coil compression spring (87) forming a rear engagement spring, see FIGS. 7-8. This engagement spring (87) is supported on the lock cover (42), see FIG. 10.

In place of the coil compression springs (86, 87) also flat leaf springs may be used which, depending on their installation position, slide along the lock bottom (41), the lock cover (42) or the brake catcher (50).

In the lock box (40), which is for example a rectangular thin-walled metal sheet container, the brake catcher (50) is longitudinally movably supported. The extended brake catcher (50), see FIGS. 1 and 5, is guided on one hand, in the catcher opening of the cover plate (31). On the other hand, the elongate walls of the elongated damper opening (74) abut a guide web 43, which is attached to, or formed onto, the lock bottom wall (41).

In FIG. 5, a web-like stop (45) is shown behind the extended brake catcher (50). The stop (45) is visible in cross-section also in FIG. 10. It has a blocking flank (46). The blocking flank (46) extends at least approximately normal to the lock bottom wall (41) and transverse to the direction of movement (7, 8) of the brake catcher (50).

Spatially below the cutout (72) of the brake catcher (50), the pivot nut (103) is disposed in a bore (48) of the lock bottom wall (41). In the pivot nut (103), see FIGS. 1 and 7, there is a central square opening (105) in which the square bolt (101) of the handle (100) is accommodated in a form-fitting manner. The pivot nut (103) is engaged by a so-called chain spring (108), which is fixed at its end remote from the pivot nut in a spring support structure (109). The chain spring (108) pivots the pivot nut (103) in accordance with FIGS. 1, 3, and 5 in a counter-clockwise direction. Between the pivot nut (103) and the cover plate (31), a stop bolt (49) is disposed.

By way of the cover plate (31), that is, the front wall of the lock box (40), the lock box (40) is inserted into a cavity (13) in the door panel (10) and fixed, see FIGS. 11 and 12.

In FIG. 2, the fixture (24) is shown as a damper arrangement counterpart (110). The frame fixture (24) consists of an angled closing metal sheet (111) and an integrated catcher element (112). Both parts (111, 112) are rigidly interconnected. The catcher element (112) has a brake catcher cutout (115) in which the brake catcher (50) is accommodated when the door is being closed. Below this catcher opening (25) and the cutout (115), there is another lock opening (26) into which a lock member engages when the door is locked.

The cutout (115) comprises primarily two parallel narrow grooves (116, 117). Both grooves extend at an angle of 45° with respect to the front surface (113) of the angled metal closing sheet (111). The groove flanks of the wider and longer groove (116) extend for example parallel to the front face (55) of the brake catcher (50). The web disposed between the two grooves (116, 117) is cut in the center area thereof so that in the upper and lower area of the cutout (115) two tongue-like trigger elements (121, 122) remain. The groove (117) is further provided at the catcher side with a cutout (118) of triangular cross-section, see FIG. 4, which provides for space for accommodating the head section (61) of the brake catcher (50).

The simplified frame fitting (24) according to FIGS. 11-16 includes as cutout (115), a groove and a trigger element (121) projecting toward the door. The groove (115) and the trigger element (121) have a common engagement flank (123).

The FIGS. 11 and 12 show a simplified variant of the damper fixture. According to FIG. 11, in the lock box (40) of the open door, the brake catcher (50) abuts the rear stop (45). In this position, it is held by the spring element (99), which, in this case, is a tension spring. The simplified brake catcher (50) is shown dimetricly in FIG. 11. It is in principle, a cuboid on which the brake webs (63) are arranged by way of a connecting web (62).

Below the spring elements (9), a gas or hydraulic damper (90) is arranged. The damper (90) however, may also be based on a mechanical operating principle. The cylinder (91) of the damper (90) is connected to the brake catcher 950) whereas the piston (92) or, respectively, the piston rod (94) is linked to the lock box (40). The brake web (63) projects from the lock box (40) just far enough that the brake surface (68) of the brake catcher (50) overlaps the engagement flank (123) of the frame fixture (24) for example by 0.5-3 mm.

As soon as the closing door (1) comes into contact with the engagement flank (123) via the brake surface (68), the brake surface (68) slides along the engagement flank (123) while pulling out the brake catcher (50). The pulling out movement is damped by extension of the damper piston (92). At the same time, the tension spring (99) is tensioned. When the door is closed, the brake web (63) projects into the cutout (115).

Figure 14:
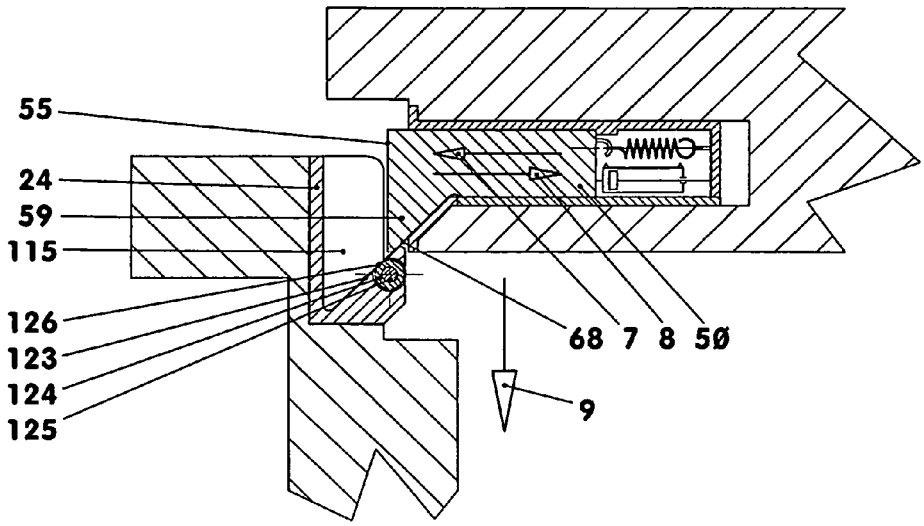
FIG. 14: like FIG. 11, but with a hook-like brake catcher.

In the damper fixture, the direction (9) of the door closing movement is redirected by the combination of the brake web (63, 64) or, respectively, the hook section (59), see FIG. 14, and the trigger element (121, 122) into the brake catcher movement direction (7) which is turned by about 90 angular degrees. Herein, the parts (63, 64, 59) and (121, 122) form a kind of wedge drive. To this end, the brake webs and the hook section include the brake surfaces (67, 68), whereas the trigger elements are provided with the engagement flanks. If the inclination of the surfaces and flanks with respect to the direction (7) is less than 45 angular degrees, the damper path available to the damper is lengthened. If the inclination is less than 45 angular degrees, the damper path is shortened.

Since, with a pivot movement, the door (1) approaches the frame fixture (24), the brake surfaces contact the engagement flanks not in an areal way. Generally, the individual brake surface (69) slides along the front edge of the engagement flank (123) and comes in full contact with the engagement flank (123) only in the end phase of the closing movement.

Figure 16:
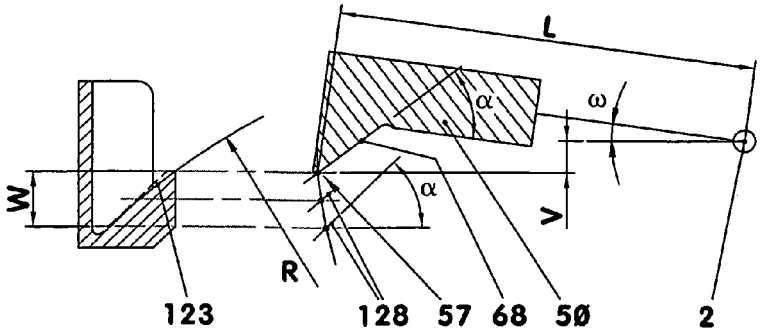
FIG. 16: geometric relationships between the brake surfaces and the engagement flank.

In order to avoid an abrasive contact with the engagement edge, the engagement flank may be curved, see FIG. 16. If the maximum radius of curvature (R)—the formula designations are explained at the end of the reference numeral listing—is calculated as follows:

$$R = \frac{W}{2 \times \sin(\alpha - \omega/2)) \times \sin(w/2)} \text{ wherein } w = \arcsin(W/L),$$

the brake surface (68) abuts the engagement flank (123) tangentially over the whole slide area.

The formulas are valid only for a positive displacement (V), which is generally always ensured, since the door pivot axis (2) is normally arranged at the level of the overlay. Such a design of an engagement flank curvature reduces the annoying contact noise occurring between the fittings (14) and (24). In addition, it reduces the wear between the contact surfaces because the surface pressure is substantially reduced there.

In the simplified variants of the FIGS. 11-13 or respectively, 14, 15, the brake catcher (50) pushes the door panel (10) again toward an open position after completion of the door closing movement by the effect of the tension spring (99). The damping fixture requires in this case a door locking mechanism which locks the door panel (10) upon reaching the closed door position for example to the frame fixture (24). Such a locking mechanism is integrated into the variant according to the FIGS. 1-9. The locking however can also be realized by a separate roller catcher lock.

In this connection, FIG. 7 shows the frame fixture (24) and the lock box (40) with the brake catcher (50). In the elongated damper opening (74), see FIGS. 1, 3 and 5, the cylinder (91) of the damper (90) is disposed between the support plate (85) and the right end of the elongated damper opening (74). If appropriate, the support plate (85) is part of the damper (90). The piston (92), which may, for example, have no piston rod, has a piston end plate (93) is spherically curved, for example. Between the piston end plate (93) and the support plate (85), a coil compression spring (99) is disposed on the piston (92). The latter has the effect that the brake catcher (50) is pressed toward its rear position, see FIGS. 7 and 8.

As shown in FIGS. 7 and 8, the brake catcher is locked in its rear position. To this end, the brake catcher (50) is disposed with the lock bottom side (53) thereof on the projecting engagement ledge (47) of the web-like stop (45), see also FIG. 10. By the engagement spring (87) of the bottom section (81) which supported on the lock cover (42), it is pressed against this ledge (47). With the head section (61), the brake catcher (30) abuts the web (33) via the engagement ledge (33) of the cover plate (31). It is pressed against the engagement ledge (33) of the cover plate by an engagement spring (86) which is arranged in the center section of the brake catcher (50).

When now, upon closing of the door, the lock box, which is disposed in the door panel, moves, with the brake catcher (50) retracted, in the direction (9) toward the angled metal closing sheet (111) and the catcher element (112) of the door frame (20), as shown in FIG. 8, first the brake web (63)—see FIG. 9—comes into contact with the engagement flank (123) of the trigger element (121). As a result, the brake catcher (50) is pivoted by for example 1 angular degree about the engagement ledge (47) forming a fictive pivot axis against the pivot movement of the door being closed. As a result of the pivoting the engagement ledge (69) is moved off the cover plate web (33). The locking of the brake catcher (50) is omitted thereby. By way of the brake webs (63, 64), the brake catcher is extended in a damped manner. Herein, the lock bottom side (53) of the brake catcher (50) slides along the edge (47) of the stop (45) until the rear front surface (56) is disposed in front of the blocking flank (46) of the stop (45), see FIG. 10. In front of the blocking flank (46), the rear bottom end edge (58) of the brake catcher (50) is pressed against the lock bottom (41) by the engagement spring (87) and is retained there in place. The brake catcher (50) is then locked.

In order to again open the door, the handle (100) must be operated by pushing it downwardly. Upon operating the handle (100), the pivot nut cam (104) is pivoted clockwise in the elongated cam opening (76), see FIG. 5.

In accordance with FIG. 8, the pivot nut cam (104) hits in the elongated cam opening (76) the disengagement ramp (77). As a result, the brake catcher (50) is lifted off the lock bottom wall (41) over the engagement ledge (47) of the stop (45), whereby it is again moved by the spring element (99) back to the rearward position.

Figure 15:
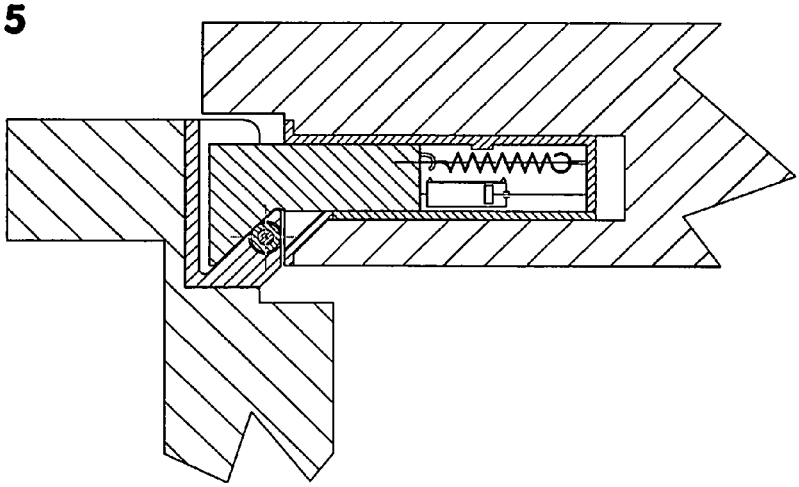
FIG. 15: like FIG. 14, but with the door closed.

The FIGS. 14 and 15 present a solution concept, wherein the brake catcher (50) has a brake surface (68), which is part of a projecting hook section (59). Also, the front face (55) of the brake catcher (50) is oriented for example transverse to the direction (8) of the brake catcher movement.

Furthermore, in the frame fixture (24) a roller (124) is roatatably supported by a shaft (125) in the area of the engagement flank (123). The shaft (125) is so positioned in the fixture (24) that, for example, the cylindrical radially outer surface (126) projects a few tenths of a millimeter over the engagement flank (123). As a result, the brake surface (68) can at least in some areas roll off on the roller (124). In place of the roller (124), the rolling body used may also be in the form of a drum or an ellipsoid frustum. Also, the shape of the hook section (59) in combination with the support structure for, and the size of, the roller (124) or drum may be so designed that the brake surface (68) and/or (67) rolls off during the whole damper movement. Possibly the rolling body (124) may alternatively also be arranged in the hook section (59) so that it rolls on the engagement flank (123) of the frame fixture (24).

It is of course also possible to combine the variants of FIGS. 11, 12 and 14, 15. Herein the brake surface (68) of FIG. 14 is lengthened by the formation of a cutout (65) in the brake catcher (50) as shown in FIG. 11. The brake surface (69) then extends from the tip (57) up to the top side (51). A longer brake path improves normally the damping effect.

LISTING OF REFERENCE NUMERALS

| | |
|---|---|
| 1 | Pivot door |
| 2 | Door pivot axis |
| 7 | Brake catcher, movement out of the fixture (14, 24), closing movement |
| 8 | Brake catcher, movement into the fixture (14, 24), opening movement |
| 9 | Door closing movement direction |
| 10 | Door panel |
| 11 | Overlap |
| 13 | Cavity |
| 14 | Door fixture, cover plate with lock box |
| 18 | Door outer surface |
| 20 | Door frame |
| 23 | Cutout |
| 24 | Frame fixture, fixture |
| 25 | Catcher opening |
| 26 | Lock opening |
| 27 | Mounting bores |
| 29 | Door seal |
| 30 | Damper arrangement |
| 31 | Cover plate |
| 32 | Catcher opening |
| 33 | Cover plate web, engagement stop |
| 34 | Mounting bores |
| 40 | Lock box |
| 41 | Lock bottom wall |
| 42 | Lock cover |
| 43 | Guide web |
| 45 | Stop, web-like |
| 46 | Blocking flank |
| 47 | Engagement ledge |
| 48 | Bore for (103) |
| 49 | Stop bolt |
| 50 | Brake catcher |
| 51 | Top side |
| 52 | Bottom side |
| 53 | Lock bottom side |
| 54 | Lock cover side |
| 55 | Front face up front |
| 59 | Front face, rear |
| 57 | Tip |
| 58 | Bottom end edge |
| 59 | Hook section |
| 61 | Head section |
| 62 | Connecting web |
| 63, 64 | Brake web |
| 65, 66 | Cutouts |
| 67, 68 | Walls, brake surfaces |
| 69 | Engagement ledge |
| 71 | Center section |
| 72 | Cutout |
| 73 | Flank, front |
| 74 | Elongated damper opening |
| 75 | Grooves |
| 76 | Elongated cam opening |
| 77 | Disengagement ramp, flank front, step, ramp-like |
| 78 | Dead end bore for (86) |
| 79 | Counter surface |
| 81 | Bottom section |
| 83 | Flank near |
| 84 | Dead end bore for (87) |
| 85 | Support plate |
| 86 | Engagement spring, front, coil compression spring |
| 87 | Engagement spring, rear, coil compression spring |
| 90 | Damper |
| 91 | Cylinder |
| 92 | Piston |

-continued

| | |
|---|---|
| 93 | Piston end plate |
| 94 | Piston rod |
| 99 | Spring element, compression spring, tension spring |
| 100 | Handle |
| 101 | Square bolt |
| 103 | Pivot nut |
| 104 | Pivot nut cam |
| 105 | Square opening |
| 106 | Outer wall, cylindrical |
| 108 | Chain spring |
| 109 | Chain spring support structure |
| 110 | Damper arrangement counter part |
| 111 | Angled metal closing sheet |
| 112 | Catcher element |
| 113 | Front surface |
| 115 | Brake catcher cutout |
| 116 | Groove for (63, 64) |
| 117 | Groove for (79) |
| 118 | Cutout |
| 121, 122 | Trigger elements, tongue-like |
| 123 | Engagement flank |
| 124 | Roller, drum |
| 125 | Shaft |
| 126 | Outer surface, radial, of (124), part of the engagement or brake flank |
| 128 | Tangents on (123) |
| L | Distance between the tip (57) of the retracted brake catcher and the door pivot axis (2) |
| R | Radius of curvature of the engagement flank (123) |
| V | Displacement of (2) from the front edge of (123) parallel to (8) |
| W | Distance which the tip (57) travels in the direction (9) |
| α | Angle of the brake surface (68) relative to the direction (8) |
| w | Pivot angle of the door during the slide movement of the brake catcher (50); w = 0, when the door is closed |

What is claimed is:

1. A damping mechanism for a pivot door (1) arranged in a door frame (20), comprising a door fixture (14) arranged in, or on, a door panel (10), a frame fixture (24) arranged in, or on the door frame (20), a damper arrangement (30) arranged in one of the door fixture (14) and the frame fixture (24) and a damper arrangement counter part (110) mounted in the other one of the door fixture (14) and the frame fixture (24), the damper arrangement (30) including a brake catcher (50) provided with at least one brake surface (67, 68) and supported in the respective fixture (14 or 24) and being biased by a spring element (99) into a rear position, the brake surface projecting from the respective fixture (14 or 24)

the damper arrangement (30) including a damper member (90) arranged in the fixture (14 or 24) and attached to the brake catcher (50) and the fixture (14, 21) for impeding movement of the brake catcher (50) out of its rear position, and the damper arrangement counterpart (110) including at least one trigger element (121, 122) with an engagement flank (123), wherein, during closing of the door panel, the brake surface (67, 68) abuts the engagement flank (123) of the trigger element (121, 122) allowing the brake catcher (50) to move from the rear position, toward an extended position, pulling at the same time the damper member (90), the damper member (90) being configured to control the speed at which the brake catcher (50) can be pulled out of its rear position against the force of the spring element (99).

2. A damping mechanism according to claim 1, with the damper arrangement disposed in, or on, the door panel (10), wherein the brake surface (67, 68) of the brake catcher (50) has a surface normal, whose direction differs from the direction (9) of the closing movement of the door by 15-75 angular degrees, wherein the surface-normal is composed of two positive components which extend normal to each other and of which one is oriented in the direction (9) of the door closing movement, whereas the other points at least approximately in the direction (8) toward the pivot support of the door panel (10).

3. A damping mechanism according to claim 1, with the damper arrangement disposed in, or on, the door frame, wherein the brake surface (67, 68) of the brake catcher (50) has a surface normal, whose direction deviates from the direction (9) of the door closing movement by 15-75 angular degrees, wherein the surface normal is composed of two positive components which extend normal to each other and of which one points in a direction opposite to the direction (9) of the door closing movement, whereas the other points at least approximately in the direction (7) which is opposite a direction pointing to the pivot bearing of the door panel (10).

4. A damping mechanism according to claim 2, wherein the movement directions (7, 8) are disposed in a plane which is oriented normal to the pivot axis of the door panel (10).

5. A damping mechanism according to claim 2, wherein the movement directions (7, 8) are parallel to the outer, surface (18) of the door.

6. A damping mechanism according to claim 2, wherein the brake catcher (50) includes two brake webs (63, 64) which are oriented parallel to the pivot axis of the door and whose free ends are at opposite sides of the brake catcher (50) farthest remote from each other.

7. A damping mechanism according to claim 1, wherein the frame fixture (24) comprises a catcher element (112) provided with the two trigger elements (121, 122) which are oriented parallel to the door pivot axis and whose free ends face each other.

8. A damping mechanism according to claim 1, wherein the brake catcher (50) is supported and guided in a lock box (40).

9. A damping mechanism according to claim 8, wherein the brake catcher (50) is lockable in the lock box (40) in a front and a rear position by means of two engagement stops (33, 45) and two compression springs (86, 87) biasing the brake catcher (50) into engagement with the engagement stops (33, 45).

10. A damping mechanism according to claim 1, wherein the damper member (90) damps a brake catcher movement which the brake catcher (30) executes when moving out of the lock box (40).

11. A damping mechanism according to claim 1, wherein the damper member (90) is based on one of a mechanical, a pneumatic and a hydraulic operating principle.

* * * * *